US009204498B2

(12) United States Patent
Tada

(10) Patent No.: US 9,204,498 B2
(45) Date of Patent: Dec. 1, 2015

(54) CLOTH MATERIAL

(71) Applicant: TOYOTA BOSHOKU KABUSHIKI KAISHA, Aichi-ken (JP)

(72) Inventor: Masao Tada, Aichi-ken (JP)

(73) Assignee: TOYOTA BOSHOKU KABUSHIKI KAISHA, Aichi-Ken (JP)

( * ) Notice: Subject to any disclaimer, the term of this patent is extended or adjusted under 35 U.S.C. 154(b) by 144 days.

(21) Appl. No.: 13/930,571

(22) Filed: Jun. 28, 2013

(65) Prior Publication Data

US 2015/0001205 A1 Jan. 1, 2015

(51) Int. Cl.
*H05B 3/34* (2006.01)

(52) U.S. Cl.
CPC ..... *H05B 3/342* (2013.01); *H05B 2203/011* (2013.01); *H05B 2203/014* (2013.01); *H05B 2203/029* (2013.01)

(58) Field of Classification Search
CPC ..... H05B 2203/015; H05B 2203/029; H05B 2203/035; H05B 2203/036; H05B 2203/033; H05B 2203/011; H05B 2203/017; H05B 2203/005; H05B 3/34; H05B 3/342; H05B 3/345; H05B 3/347; H05B 3/56; H05B 3/565
USPC ..... 219/217, 528–529, 542–543
See application file for complete search history.

(56) References Cited

U.S. PATENT DOCUMENTS

| | | | |
|---|---|---|---|
| 2007/0210074 A1 | 9/2007 | Maurer et al. | |
| 2011/0278282 A1 | 11/2011 | Kato et al. | |

FOREIGN PATENT DOCUMENTS

| | | |
|---|---|---|
| CN | 101039538 | 9/2007 |
| CN | 102256395 | 11/2011 |
| JP | 2007-227384 | 9/2007 |
| JP | 2008-0006074 | * 1/2008 |
| JP | 2008-006074 | 1/2008 |
| JP | 2011-074538 | 4/2011 |
| JP | 2011-243312 | * 12/2011 |
| JP | 2011-243435 | 12/2011 |
| JP | 2011-255550 | 12/2011 |

OTHER PUBLICATIONS

Office Action issued in China Counterpart Patent Appl. No. 201310269079.3, dated Aug. 3, 2015, along with a partial English translation thereof.

Office Action issued in Japan Counterpart Patent Appl. No. 2012-066259, dated Jul. 28, 2015, along with a partial English translation thereof.

* cited by examiner

*Primary Examiner* — Shawntina Fuqua
(74) *Attorney, Agent, or Firm* — Greenblum & Bernstein P.L.C.

(57) ABSTRACT

A cloth material of the invention includes a cloth material main body that includes a plurality of conductive wires that generate heat by conduction, and a conductive connecting member that is provided on a side portion of the cloth material main body and electrically connects the plurality of conductive wires together. End portions of the plurality of conductive wires are exposed from the side portion of the cloth material main body so as to be exposed portions. The connecting member electrically connects the plurality of conductive wires together by being welded in a state sandwiching the exposed portions and the side portion of the cloth material main body. Welded portions formed by the welding are arranged alternately with non-welded portions, lined up in a line.

8 Claims, 10 Drawing Sheets

CLOTH MATERIAL

BACKGROUND OF THE INVENTION

1. Field of the Invention

The invention relates to a cloth material. More particularly, the invention relates to a cloth material in which a connecting member for providing an electrical interconnection is attached to a side portion of a cloth material main body, without the flexibility of the cloth material itself being lost.

2. Description of Related Art

One known way to heat a seating surface of a seat in a vehicle, particularly a passenger vehicle or the like, is to use conductive wire for a portion of the constituent yarn of woven fabric or knit fabric that forms a cover, and pass current through this conductive wire to generate heat and raise the temperature. More specifically, a cloth material that includes conductive wire that generates heat by conduction is known, for example. A portion of the conductive wire in this cloth material in the length direction thereof is provided exposed to the outside from the cloth material. Japanese Patent Application Publication No. 2011-243312 (JP 2011-243312 A) describes technology in which a first planar body and a second planar body, at least one of which is conductive, are electrically connected to an exposed portion of this conductive wire that is exposed to the outside, by being integrally heat welded to the exposed portion in a state sandwiching the exposed portion and in surface contact with it.

However, with the cloth material described in JP 2011-243312 A, at one end portion of this cloth material, the first planar body and the second planar body are completely face-bonded by the heat welding. Also, a bonded portion of the end portion of the material cloth ends up hardening by this kind of complete face-bonding, so flexibility of the cloth material itself ends up being lost. If the cloth material has poor flexibility, the ability of the cloth material to follow the shape of the seat is diminished and the quality of the external appearance may be lost. Also, when a person is seated, the cloth material may feel hard and be uncomfortable to the seated person. Therefore, there is a need for a cloth material in which a connecting member for providing an electrical interconnection is attached to a side portion of a cloth material main body, without the flexibility of the cloth material itself being lost.

Technology in which a first planar body and a second planar body of a cloth material are joined by sewing instead of by heat welding is also known. In this case, the flexibility of the cloth material itself at the cloth material end portion is sufficiently retained. However, if a thread breaks in one seam, the connection pressure ends up decreasing over the entire seam, so an electrical connection with the conductive wire may no longer be able to be sufficiently obtained. Furthermore, with sewing, the connection area of the planar bodies on the front and back is small, and in order to obtain the necessary connection area, sewing must be performed at least twice, which leads to an increase in the number of processes. Also, the conductive wire or conducting wire that gives the planar body conductivity may end up breaking due to contact between a sewing needle and the conductive wire or the conducting wire when sewing is being performed. Moreover, the sewing needle may tend to wear from this contact.

SUMMARY OF THE INVENTION

The invention thus provides a cloth material in which a connecting member for providing an electrical interconnection is attached to a side portion of a cloth material main body, without the flexibility of the cloth material itself being lost.

One aspect of the invention relates to a cloth material that includes a cloth material main body that includes a plurality of conductive wires that generate heat by conduction, and a conductive connecting member that is provided on a side portion of the cloth material main body and electrically connects the plurality of conductive wires together. End portions of the plurality of conductive wires are exposed from the side portion of the cloth material main body so as to be exposed portions. The connecting member electrically connects the plurality of conductive wires together by being welded in a state sandwiching the exposed portions and the side portion of the cloth material main body. Welded portions formed by the welding are arranged alternately with non-welded portions, lined up in a line. In the aspect described above, the welded portions may be formed on the conductive wires. Also, in the aspect described above, an outer periphery of the welded portions may be round. Also, in the aspect described above, the welded portions may be concave portions that are recessed with respect to a surrounding area thereof, and be formed so as to change in a rounded manner without any corners, from a bottom surface portion to a side surface portion of the concave portions. Also, in the aspect described above, a plurality of rows in which the plurality of the welded portions are arranged alternately with non-welded portions lined up in a line may be formed. Also, the plurality of rows may be formed parallel. Further, the welded portions that are adjacent in a given row, from among the plurality of rows, may be arranged such that, if another row were parallel-shifted so as to overlap with the given row, at least a portion of the welded portions in the given row would overlap with the welded portions in the other row, and the alternately arranged welded portions would be connected by the welded portions that are adjacent in the given row overlapping with the plurality of welded portions that have been parallel-shifted.

With the cloth material described above, the connecting member for providing electrical interconnection is welded sandwiching the end portions of the conductive wires (i.e., the exposed portions) and the side portion of the cloth material main body having the conductive wires. Also, the welded portions formed by this welding are arranged lined up at intervals in a line with the non-welded portions in between. Therefore, a loss of flexibility of the cloth material end portion due to attaching the connecting member onto the surface can be inhibited, so flexibility of the cloth material itself can be sufficiently maintained. Moreover, a decrease in the connection pressure due to thread breakage that may occur with sewing will not occur, so the connection pressure is able to be maintained over an extended period of time. Also, when the welded portions are formed on the conductive wires, the conductive wires are able to be more reliably electrically connected together. Furthermore, the outer periphery of the welded portions is formed round, so damage to the conductive wires during welding is able to be sufficiently inhibited. Also, the welded portions are concave portions that are recessed with respect to the surrounding area, and are formed so as to change in a rounded manner without any corners, from the bottom surface portion to the side surface portion of the concave portions, so damage to the conductive wires during welding is able to be sufficiently inhibited. Also, by forming the plurality of rows parallel, the connection area needed for electrical connection is able to be sufficiently obtained, and the connection pressure is able to be maintained over an extended period of time. Moreover, the welded portions that are adjacent in a given row, from among the plurality of rows, are arranged such that, if another row were parallel-shifted so as to overlap with the given row, at least a portion of the welded portions in the given row would overlap with the welded portions in the other row, and the alternately arranged welded portions would be connected by the welded portions that are adjacent in the given row overlapping with the plurality of welded portions that have been parallel-shifted. Therefore, the exposed portions of the conductive wires are able to be reliably sandwiched by the welded portions, such that the plurality of conductive wires are able to be reliably electrically connected together.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
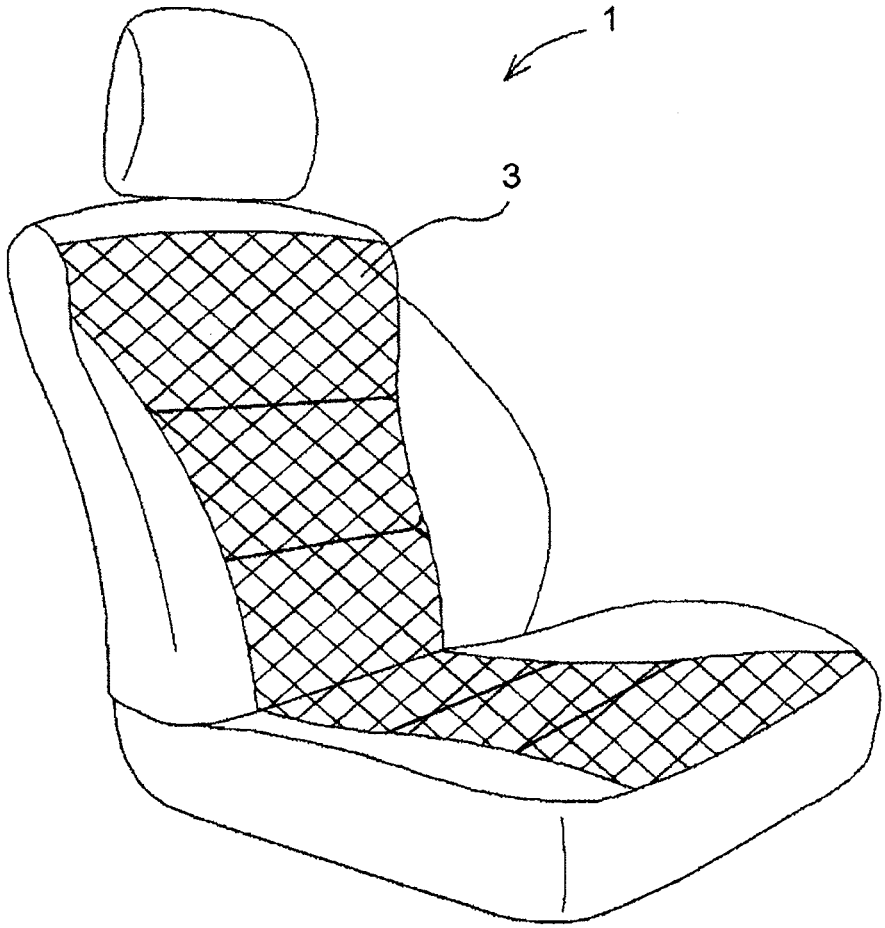
FIG. 1 is a perspective view of a vehicle seat to which a cloth material according to one example embodiment of the invention has been applied.
Figure 2:
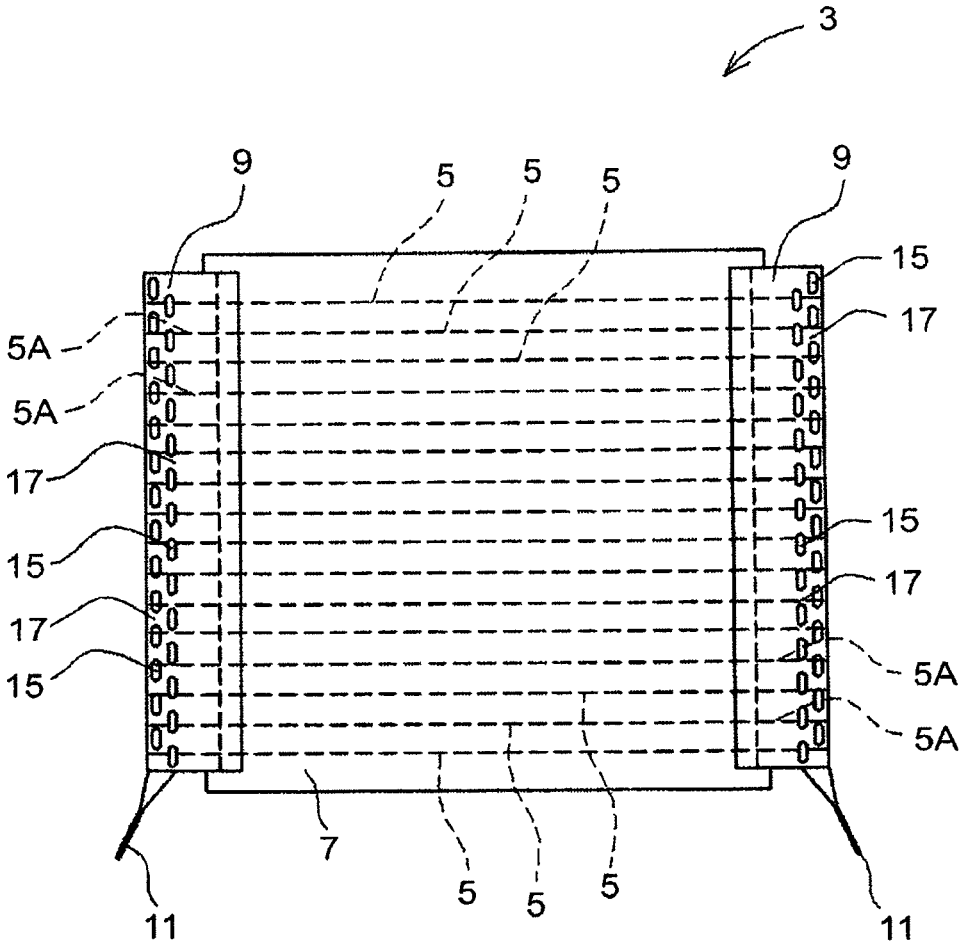
FIG. 2 is a view showing a frame format illustrating the cloth material according to the example embodiment.
Figure 3:
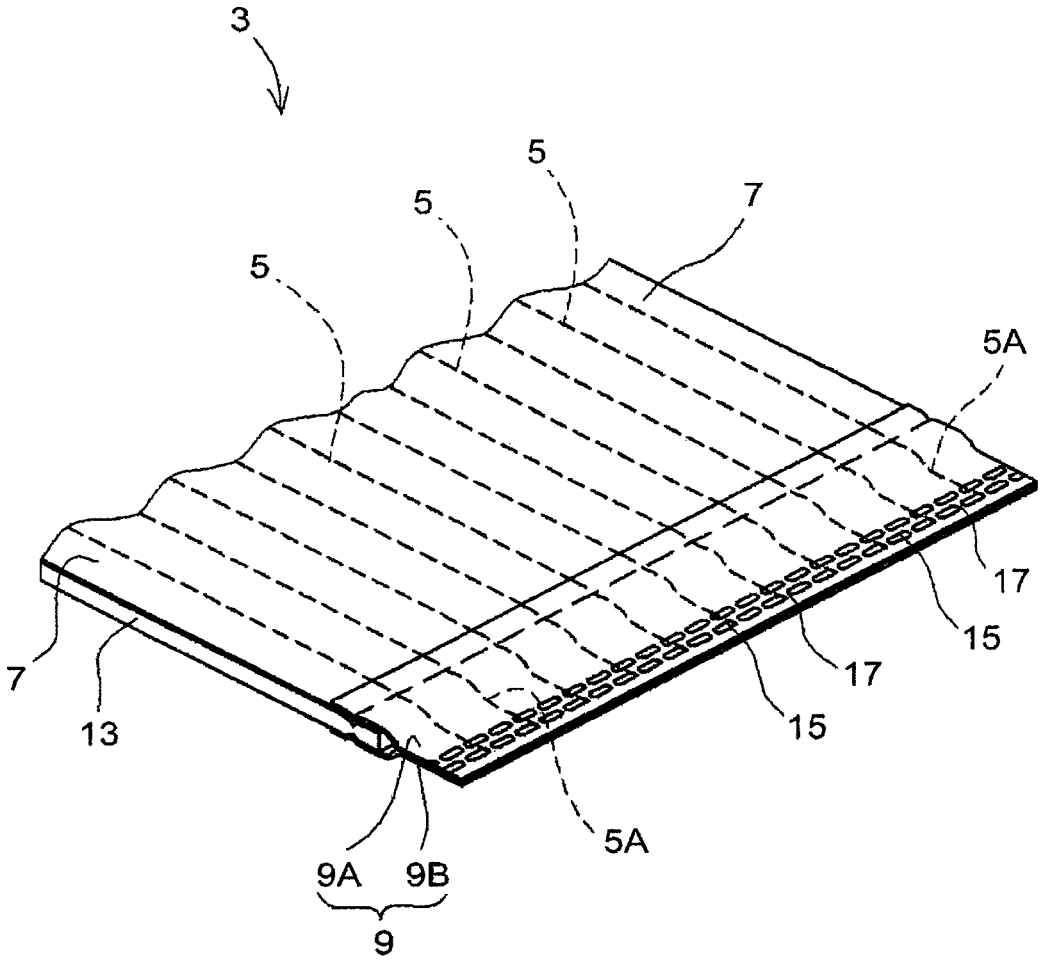
FIG. 3 is a view showing a frame format illustrating the cloth material according to the example embodiment.

The invention will be further described in detail below with reference to the plurality of previously-mentioned drawings, giving non-limiting examples of typical example embodiments of the invention. Like reference characters are used to denote like parts throughout several drawings.

The matter illustrated here intended to describe, by way of example, exemplary modes and example embodiments of the invention. This matter is described for the purpose of providing what is considered to be a description that describes the principles and conceptual characteristics of the invention in a most effective and easily understandable manner. In this regard, the description, together with the drawings, makes clear to one skilled in the art ways in which several modes of the invention are actually realized, without intending to describe structural details of the invention beyond what is necessary to gain a fundamental understanding of the invention.

Hereinafter, the invention will be described in detail. A cloth material of the invention includes a cloth material main body that includes a plurality of conductive wires that generate heat by conduction, and a conductive connecting member that is attached to a side portion of the cloth material main body and electrically connects the plurality of conductive wires together. Also, end portions of the plurality of conductive wires are exposed from the side portion of the cloth material main body so as to be exposed portions. Also, the connecting member electrically connects the plurality of conductive wires together by being welded in a state sandwiching the exposed portions and the side portion of the cloth material main body. Welded portions formed by this welding are arranged lined up at intervals in a generally straight line with non-welded portions in between.

Some possible examples of the cloth material main body are woven fabric and knit fabric that uses a plurality of conductive wires and a plurality of non-conductive yarns, as the constituent yarn. The woven fabric is not particularly limited, and may be any weave such as a plain weave, twill, and sateen weave. Also, the knit fabric is not particularly limited, and may either be a weft knit or a warp knit. The material of the non-conductive yarn is not particularly limited. One possible example is yarn using natural fiber that is plant based and animal based, regenerated fiber such as rayon, semi synthetic fiber such as acetate, or synthetic fiber made of synthetic resin such as polyamide or polyester, or the like. Only one kind of non-conductive yarn may be used, or two or more kinds of non-conductive yarn may be used together. These non-conductive yarns are normally insulated, with the specific resistance exceeding $10^8$ Ω·cm.

The conductive wires are conductive fiber-like material that is able to carry current (i.e., through which current is able to flow). In particular, a conductive yarn with a specific resistance (volume resistivity) measured according to JISK 7194 of 100 to $10^{-12}$ Ω·cm may be used. Examples of this kind of conductive yarn include filament of carbon fiber, metal wire, and plated wire. Only one kind of conductive wire may be used, or two or more types of conductive wire may be used together.

At the side portion of the cloth material main body, the end portions of the plurality of conductive wires are exposed from the side portion of the cloth material main body so as to be exposed portions. The method for partially exposing the conductive wires from the end portion of the cloth material main body is not particularly limited. For example, the exposed portions may be formed at the end portion where the conductive wires are exposed, by removing the non-conductive yarn and the like other than the conductive wires by heating or the like. If there is an electrical insulation covering on the conductive wires, the covering of the exposed conductive yarns may be melted or burned off (i.e., removed by melting or burning) by heating. The heating method at this time is not particularly limited. Some possible examples are a method that involves contacting a heat generating member or the like that has been raised in temperature by electrothermal heating, and a method that involves emitting a laser such as a carbon dioxide laser, a YAG laser, or an excimer laser. Of these, the method that involves emitting a laser is preferable.

Also, the cloth material main body may be such that another member, such as a cover pad or back base fabric, is provided on the back surface side.

The connecting member is normally formed by a conductive cloth that can be welded by ultrasonic waves or high-frequency waves. Also, this connecting member is arranged sandwiching, from the front side and the back side of the cloth material main body, the side portion of the cloth material main body and the conductive wires that are exposed from this side portion (i.e., the exposed portions), and attached to the cloth material main body in this state by welding with ultrasonic waves or high-frequency waves. In this way, with the cloth material of the invention, the plurality of conductive wires are electrically connected together by the conductive connecting member.

Some possible examples of the conductive cloth described above are woven fabric and knit fabric that use a plurality of conducting wires and a plurality of welding fibers, as the constituent yarn. The woven fabric is not particularly limited, and may be any weave such as a plain weave, twill, and sateen weave. Also, the knit fabric is also not particularly limited, and may either be a weft knit or a warp knit.

The conducting wires are conductive fiber-like material that is able to carry current (i.e., through which current is able to flow). In particular, a conductive yarn with a specific resistance (volume resistivity) measured according to JISK 7194 of 100 to $10^{-12}$ Ω·cm may be used. Examples of such conducting wires include filament of carbon fiber, metal wire, and plated wire. Only one kind of conducting wire may be used, or two or more types of conducting wire may be used together. The material of the welding fiber is not particularly limited as long as it has insulation properties and can be melted by ultrasonic waves or high-frequency waves. One possible example is yarn made using synthetic fiber made from synthetic resin such as polyethylene terephthalate (PET). Only one type of welding fiber may be used, or two or more types of welding fiber may be used together. For the conductive cloth, another insulating non-conductive yarn other than the conducting wires and welding fiber may also be used as the constituent yarn.

In the connecting member, welded portions formed by welding are arranged lined up at intervals in a generally straight line with non-welded portions in between. That is, a plurality of welded portions are arranged so as to form a broken line as a whole. In particular, these welded portions are preferably formed on the exposed conductive wires. The shape of the welded portions is not particularly limited, but the outer periphery of the welded portions 15 is preferably formed round. Moreover, each welded portion 15 is a concave portion that is recessed with respect to the surrounding area, and is preferably formed so as to change in a rounded manner without any corners, from a bottom surface portion 15A to a side surface portion 15B of the concave portion. The shapes of all of the plurality of welded portions may be the same or different.

Figure 7:
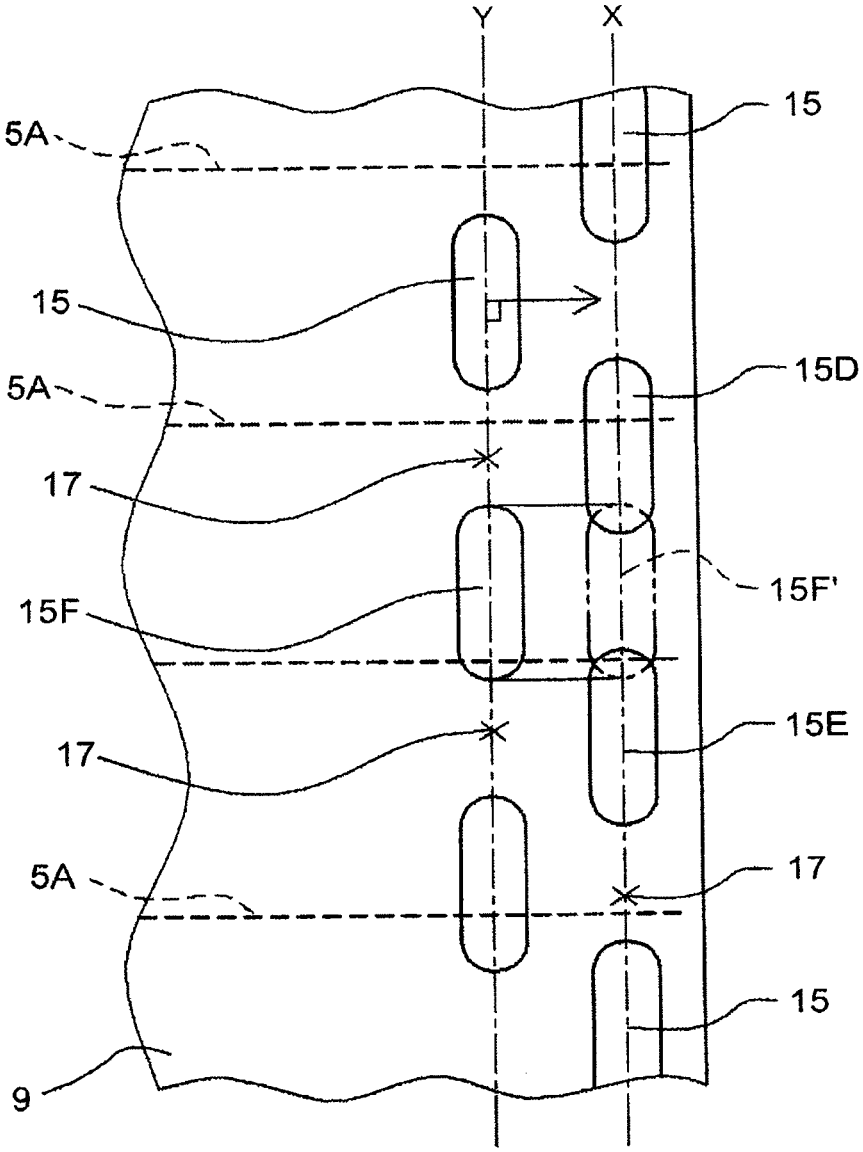
FIG. 7 is a view showing a frame format illustrating the welded portions.

One or a plurality of the broken lines formed by the plurality of welded portions arranged in a generally straight line may be formed. In particular, from the viewpoint of being able to sufficiently obtain the necessary connection area for electrical connection, and being able to maintain connection pressure over an extended period of time, a plurality of broken lines are preferably formed parallel to each other. Also, when a plurality of rows of broken lines are formed, the broken lines are preferably formed in the following manner. First, one row is parallel-shifted so as to entirely overlap with the remaining other row (more specifically, for example, as shown in FIG. 7, one row on a virtual line Y is parallel-shifted in the direction of the arrow in the drawing such that the entire virtual line overlaps with the other row on a virtual line X). At this time, two welded portions that are arranged adjacent on the other row preferably overlap with another welded portion that has been parallel-shifted (more specifically, for example, welded portions 15D and 15E that are adjacent in the other row on the virtual line X in FIG. 7 preferably overlap with a welded portion 15F' that is a welded portion 15F on the virtual line Y after it has been parallel-shifted). Moreover, when the parallel-shift has been performed in the manner described above, the welded portions arranged at intervals on the other line are preferably all connected by overlapping with the plurality of welded portions that have been parallel-shifted. In this kind of case, the exposed portions of the conductive wires are able to be reliably sandwiched by the welded portions, such that the plurality of conductive wires are able to be reliably electrically connected together.

Figure 11:
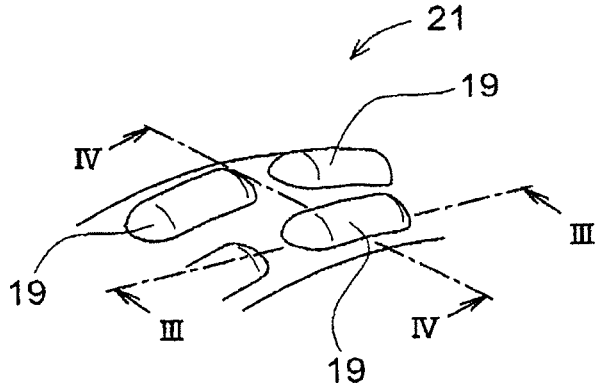
FIG. 11 is a view showing a frame format illustrating protruding portions of a pressure roller.
Figure 12:
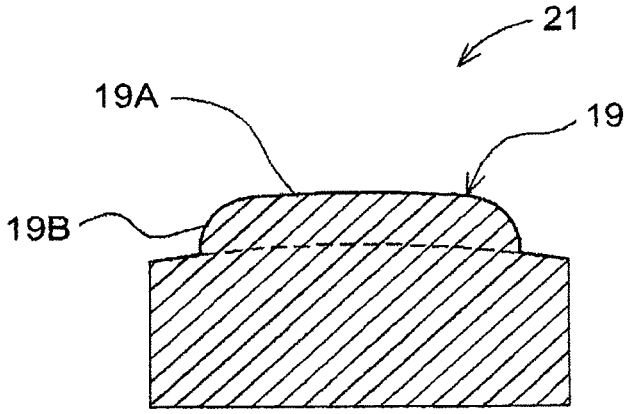
FIG. 12 is a sectional view taken along line III-III in FIG. 11.
Figure 13:
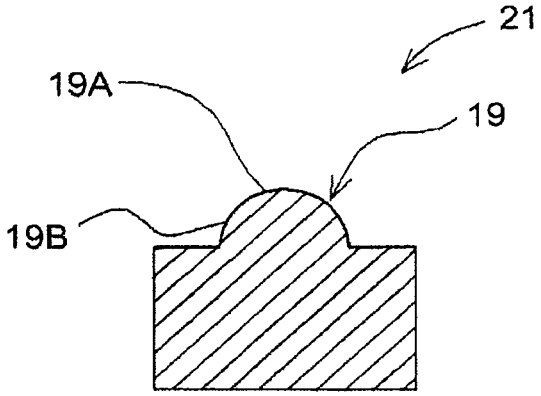
FIG. 13 is a sectional view taken along line IV-IV in FIG. 11.

Such welded portions are normally formed using an ultrasonic sewing machine or a high-frequency sewing machine provided with a pressure roller having protruding portions. The shape of the protruding portions on the pressure roller is not particularly limited, but the protruding portions are preferably protruding portions 19 that are chamfered and formed so as to change in a rounded manner without any corners, from a top portion 19A to a side surface portion 19B, as shown in FIGS. 11 to 13. In this case, damage to the exposed conductive wires and conducting wires that form the connecting member is able to be sufficiently inhibited when pressing and welding the end portion of the connecting member.

Hereinafter, the invention will be described in detail by example embodiments with reference to the accompanying drawings. In the example embodiments, a cloth material arranged on a vehicle seat will be given as an example of the cloth material of the invention.

The cloth material in one example embodiment is used as a heater region (the region with hatching) of a seat surface or a backrest of a vehicle seat 1, as shown in FIG. 1.

A cloth material 3 includes a cloth material main body 7 provided with a plurality of conductive wires 5, and a connecting member 9 that is attached to a side portion on both sides of the cloth material main body 7, as shown in FIGS. 2 to 7. Then, current is passed through the plurality of conductive wires 5 via the connecting member 9 from a power supply cable 11 that is connected to the connecting member 9, such that the conductive wires 5 are able to generate heat.

The cloth material main body 7 is a woven fabric made using a plurality of conductive wires 5 that generate heat by conduction, and non-conductive yarn. A cover pad 13 is provided on a back surface side of this cloth material main body. End portions of the conductive wires 5 are exposed from the side portion of the cloth material main body 7 so as to be exposed portions 5A, and are sandwiched by the connecting member 9. The non-conductive yarn at the side portion of the cloth material main body 7 is removed by a laser or the like.

The connecting member 9 is made from a front side conductive cloth 9A and a back side conductive cloth 9B. These conductive cloths 9A and 9B are woven fabric made using conducting wire (such as tinned copper wire) and yarn of welding fiber (such as PET fiber). The connecting member 9 is attached with the front side conductive cloth 9A and the back side conductive cloth 9B sandwiching the side portion of the cloth material main body 7 and the exposed conductive wires (i.e., the exposed portions 5A), at the end portion of the cloth material main body 7. The front side conductive cloth 9A and the back side conductive cloth 9B are integrated by sewing, so as to sandwich the cloth material main body 7 and the cover pad 13, on the cloth material main body side of the connecting member 9 (i.e., the attaching side of the connecting member 9). Meanwhile, on end portion side of the cloth material 3, the front side conductive cloth 9A and the back side conductive cloth 9B are joined by ultrasonic welding, thus forming the plurality of welded portions 15.

Figure 4:
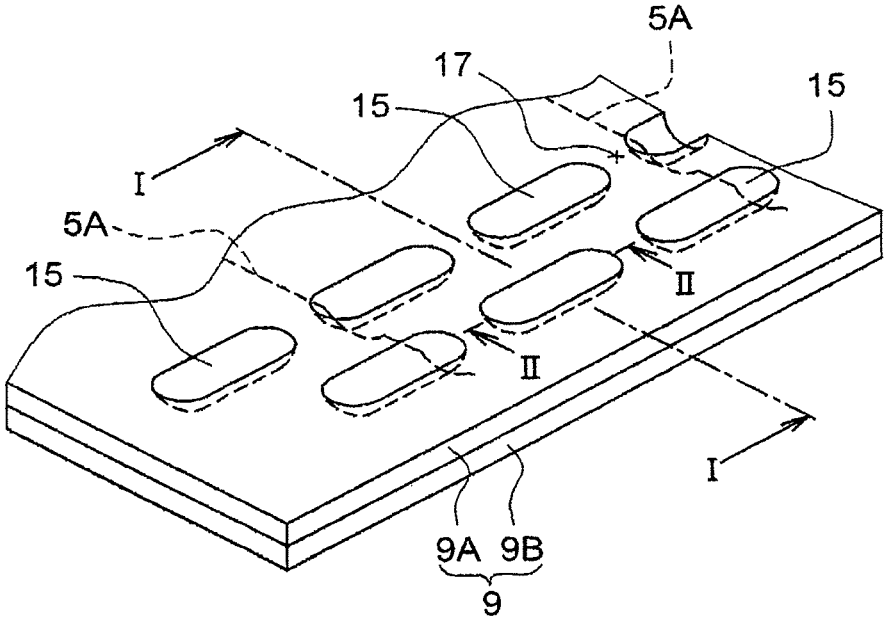
FIG. 4 is a view showing a frame format illustrating welded portions.
Figure 5:
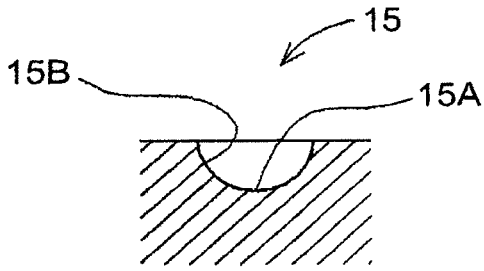
FIG. 5 is a sectional view taken along line I-I in FIG. 4.
Figure 6:
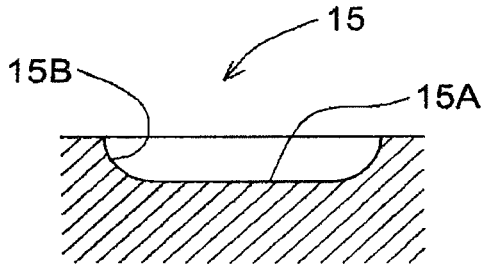
FIG. 6 is a sectional view taken along line II-II in FIG. 4.

The welded portions 15 formed by ultrasonic welding are concave portions that are recessed with respect to the surrounding area, and have round outer peripheries, as shown in FIGS. 4 to 6. Moreover, the welded portions 15 are formed so as to change in a rounded manner without any corners, from the bottom surface portion 15A to the side surface portion 15B of the concave portions. The plurality of welded portions 15 are arranged lined up at intervals with non-welded portions 17 in between, in generally straight lines (i.e., on virtual lines X and Y in FIG. 7) over two rows. Also, as shown in FIG. 7, when the row on the virtual line Y is parallel-shifted in the direction shown by the arrow such that the virtual line overlaps with the row on the virtual line X, the welded portions 15D and 15E that are adjacent on the virtual line X are arranged overlapping the welded portion 15F' that is the welded portion 15F on the virtual line Y after it has been parallel-shifted. Moreover, when this parallel-displacement is performed, the welded portions 15 that are arranged at intervals on the virtual line X are arranged so as to all be connected, by overlapping with the plurality of welded portions that have been parallel-shifted.

Figure 8:
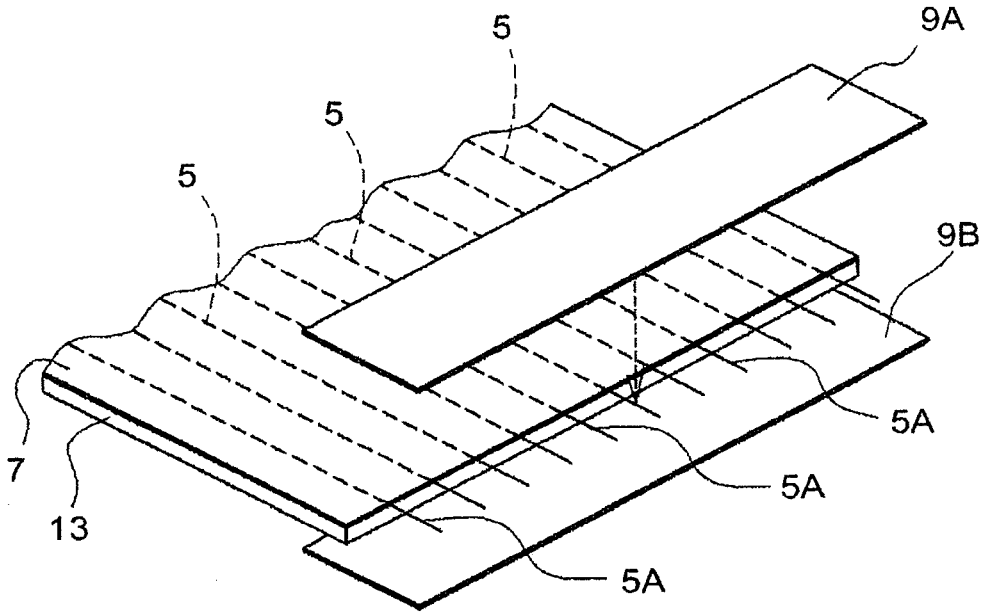
FIG. 8 is a view showing a frame format illustrating a manufacturing process of the cloth material.
Figure 9:
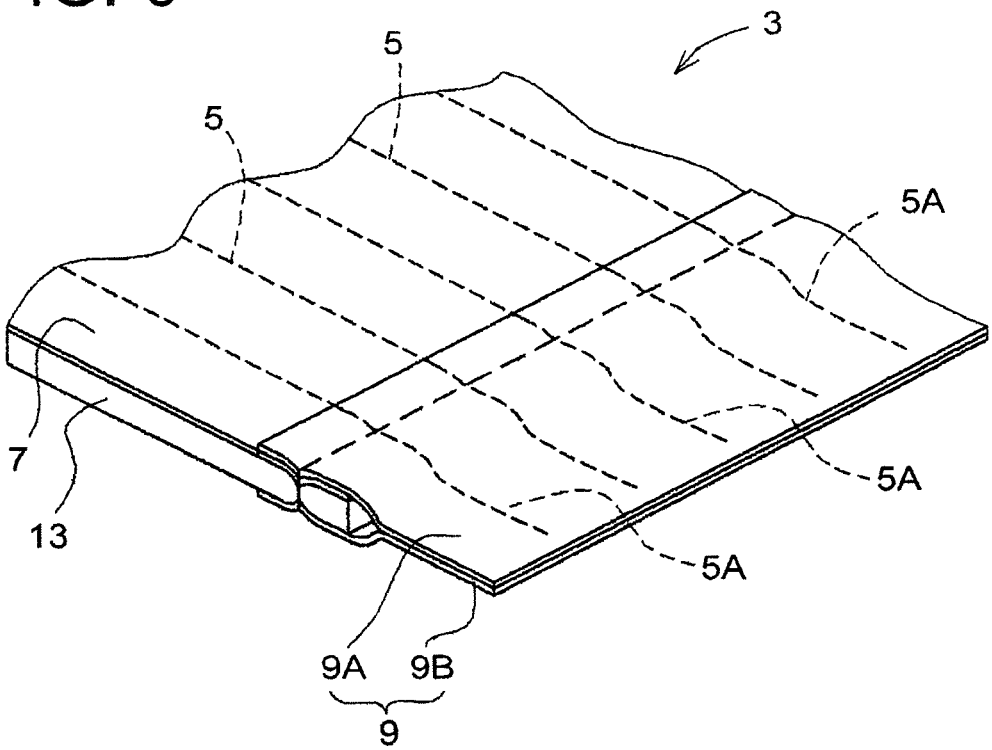
FIG. 9 is a view showing a frame format illustrating a manufacturing process of the cloth material.
Figure 10:
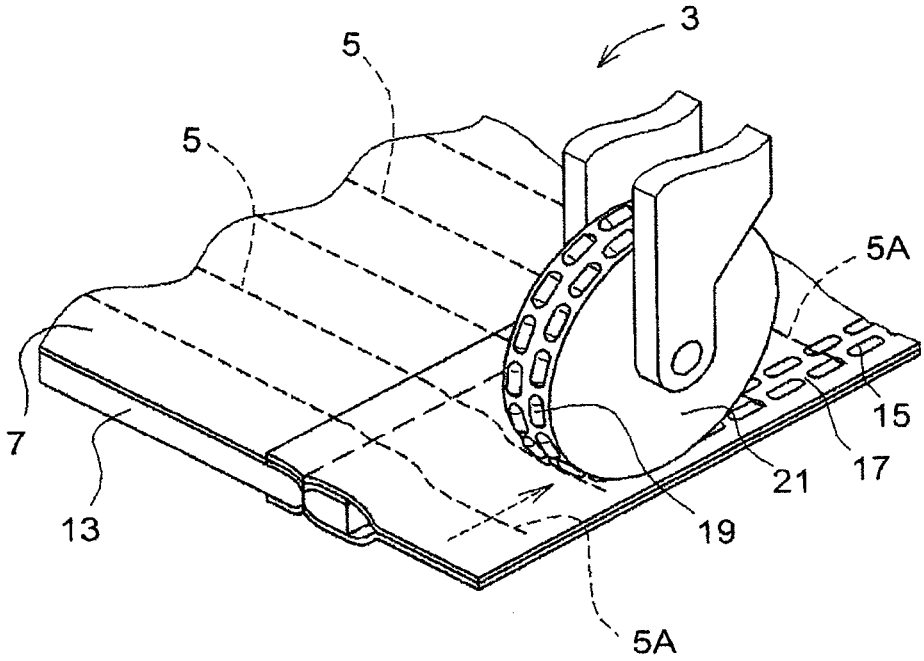
FIG. 10 view showing a frame format illustrating a manufacturing process of the cloth material.

First, as shown in FIGS. 8 and 9, one end of each of the front side conductive cloth 9A and the back side conductive cloth 9B that form the connecting member is sewn to, and thus integrated with, the end portion of the cloth material main body 7 provided with the cover pad 13 and the plurality of conductive wires 5. The end portions of the plurality of conductive wires 5 are exposed from the side portion of the cloth material main body 7 so as to be exposed portions 5A. Then, as shown in FIG. 10, the end portions of the front side conductive cloth 9A and the back side conductive cloth 9B are ultrasonically welded using an ultrasonic sewing machine (model name PUS-1150-WA by Proco Co., Ltd.) provided with a pressure roller 21 on which protruding portions 19 are formed. The plurality of protruding portions 19 are arranged so as to form broken lines over two rows, on the surface of the pressure roller 21. Also, these protruding portions 19 are chamfered and formed so as to change in a rounded manner without any corners, from the top portion 19A to the side surface portion 19B, as shown in FIGS. 11 to 13. Therefore, the welded portions 15 formed on the cloth material 3 are arranged at intervals on generally straight lines over two rows with the non-welded portions 17 in between. Also, the welded portion 15 is a concave portion that is recessed with respect to the surrounding area and has an outer periphery that is round. Moreover, from the bottom surface portion 15A to the side surface portion 15B of the concave portion is formed so as to change in a rounded manner without any corners (see FIGS. 4 to 6). In this way, the connecting member 9 is connected to the side portion of the cloth material main body 7.

With the cloth material 3 of this example embodiment, the connecting member 9 for providing electrical interconnection is attached sandwiching the side portion of the cloth material main body 7 that has the conductive wires 5, and the end portions of the conductive wires 5 (i.e., the exposed portions 5A), by welding. Therefore, a decrease in connection pressure due to thread breakage that may occur with sewing in the related art will not occur, so the connection pressure is able to be maintained over an extended period of time. Also, the welded portions 15 formed by ultrasonic welding are arranged lined up at intervals in a generally straight line with the non-welded portions 17 in between. Therefore, a loss of flexibility of the cloth material end portion due to the entire connecting member being attached by heat welding is able to be suppressed, so the flexibility of the cloth material itself is able to be sufficiently maintained. Furthermore, as shown in FIG. 7, when the row on the virtual line Y is parallel-shifted to the row on the virtual line X, the welded portions 15D and 15E that are adjacent on the virtual line X are arranged overlapping the welded portion 15F' that has been parallel-shifted. Moreover, when this parallel-shift is performed, the welded portions 15 that are arranged at intervals on the virtual line X are arranged so that they are all connected, by overlapping with the plurality of parallel-shifted welded portions. Therefore, the majority of conductive wires that are exposed from the cloth material main body 7 (i.e., the exposed portions 5A) are sandwiched by the welded portions 15 of the connecting member 9, so electrical interconnection is reliably performed. Also, ultrasonic welding using an ultrasonic sewing machine is used to form the welded portions 15 of the connecting member 9, so sufficient connection area is able to be obtained with only one work process. Furthermore, a sewing-needle is not used, so the conductive wires 5 and the conducting wires that form the connecting member 9 will not be damaged by contact with the needle. Also, the welded portions 15 are concave portions that are recessed with respect to the surrounding area and have a round outer periphery, and are preferably formed so as to change in a rounded manner without any corners, from the bottom surface portion to the side surface portion of the concave portions. By forming the welded portions 15 in this shape, damage to the conductive wires (i.e., the exposed portions 5A) and the conducting wires that form the connecting member 9, from the protruding portions 19 of the pressure roller 21 when pressing during ultrasonic welding is sufficiently inhibited.

Figure 14:
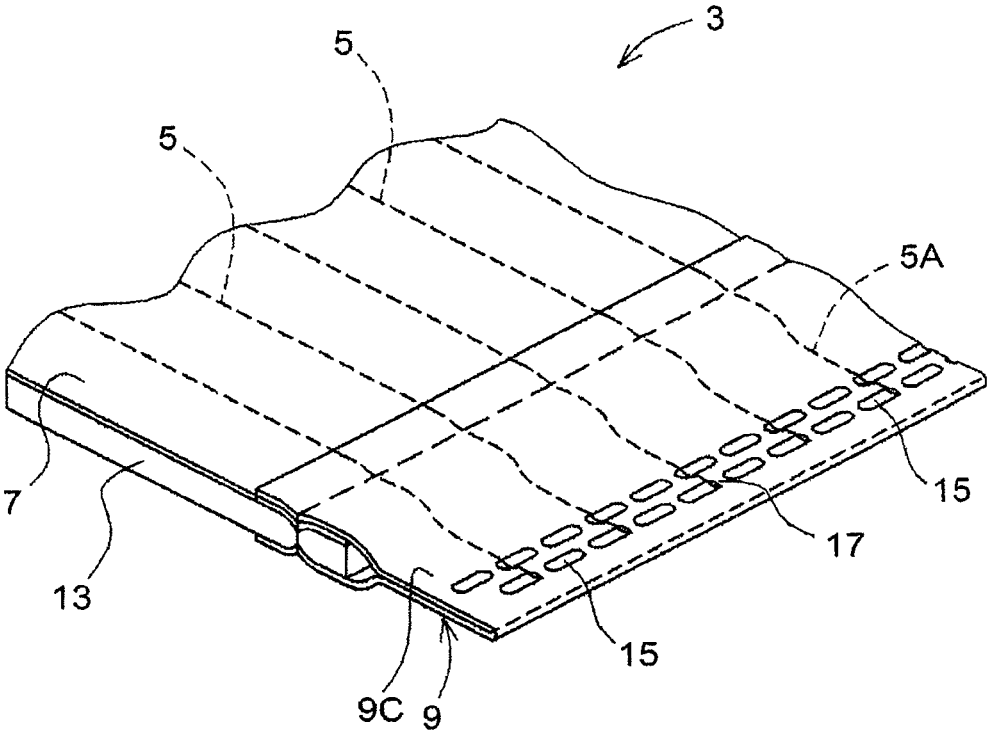
FIG. 14 is a view showing a frame format illustrating a cloth material according to another example embodiment of the invention.
Figure 15:
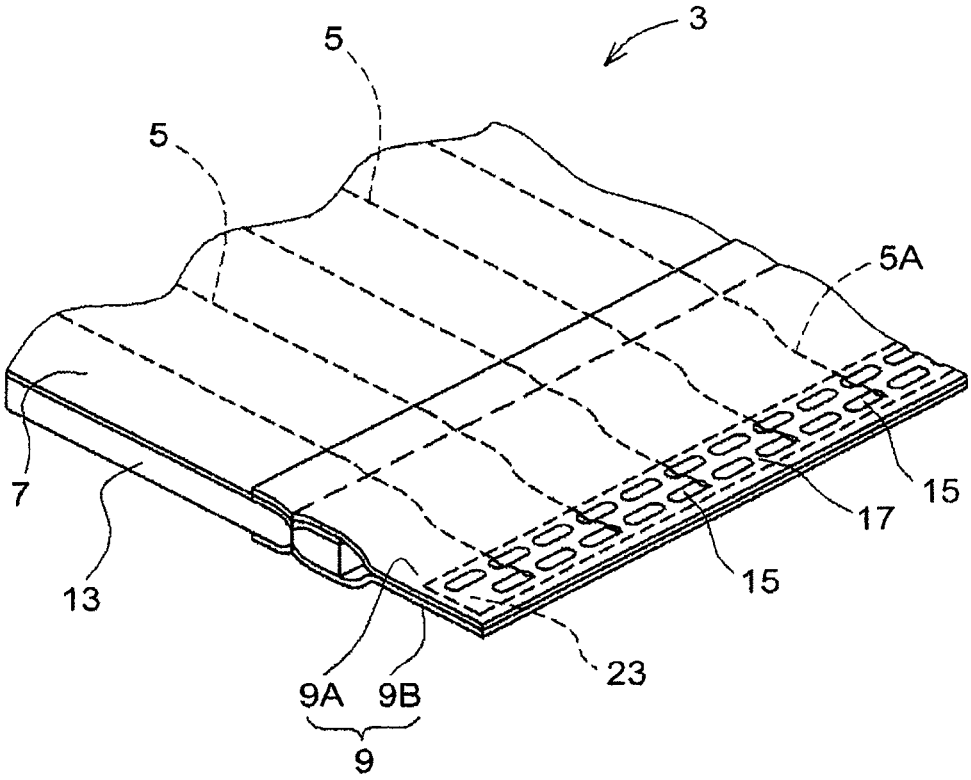
FIG. 15 is a view showing a frame format illustrating a cloth material according to yet another example embodiment of the invention.

The invention is not limited to the example embodiment described above, but may be carried out in any of a variety of modified example embodiments within the scope of the invention. That is, in the example embodiment described above, the connecting member 9 is formed by the front side conductive cloth 9A and the back side conductive cloth 9B, but the connecting member 9 may also be formed by a single sheet of conductive cloth 9C, as shown in FIG. 14. Also, in the example embodiment described above, ultrasonic welding is performed such that the conductive wires 5 are sandwiched by the front side conductive cloth 9A and the back side conductive cloth 9B on the end portion side of the cloth material 3. Alternatively, however, in order to further improve the connection strength, a planar intermediate body (such as an aluminum sheet) 23 may be interposed between the conductive wires 5 and the front side conductive cloth 9A (or the back side conductive cloth 9B), as shown in FIG. 15. Further, in the example embodiment described above, the power supply cable 11 is arranged on both sides of the cloth material 3, but it may also be arranged on only one side as long as current is able to flow to the conductive wires.

The foregoing examples are simply for the purpose of description and should not be construed as limiting the invention. The invention has been described with a typical example embodiment, but it is to be understood that the language used in the description of the invention and the drawings is descriptive and exemplary, and not limiting. As described in detail here, in this form, modifications within the scope of the appended claims, without departing from the scope or spirit of the invention, are possible. Here, the specific structure, material, and example embodiments of the invention described in detail have been referred to, but are not intended to limit the invention to the matter disclosed here. Rather, the invention covers the all functionally equivalent structures, methods, and uses within the scope of the appended claims.

The invention is not limited to the example embodiments described in detail above. That is, various modifications or variations are possible within the scope of the claims of the invention.

The cloth material of the invention may be used for a variety of products that need to be heated by raising the temperature, such as a seat cushion and a seat back for a vehicle, an electric carpet, an electric blanket, an electric massage seat for household use, and a heated motorcycle jacket and the like. The cloth material of the invention is particularly useful in a heater member that heats a product used somewhere not out of doors, such as a seat of a vehicle, e.g., a passenger vehicle.

What is claimed is:

1. A cloth material comprising:

a cloth material main body that includes a plurality of conductive wires that generate heat by conduction; and a conductive connecting member that is provided on a side portion of the cloth material main body, and electrically connects the plurality of conductive wires together, wherein end portions of the plurality of conductive wires are exposed from the side portion of the cloth material main body so as to be exposed portions; the connecting member electrically connects the plurality of conductive wires together by being welded in a state sandwiching the exposed portions and the side portion of the cloth material main body; and welded portions formed by the welding are arranged alternately with non-welded portions, lined up in a line.

2. The cloth material according to claim 1, wherein the welded portions are formed on the conductive wires.

3. The cloth material according to claim 1, wherein an outer periphery of the welded portions is round.

4. The cloth material according to claim 1, wherein the welded portions are concave portions that are recessed with respect to a surrounding area thereof, and are formed so as to change in a rounded manner without any corners, from a bottom surface portion to a side surface portion of the concave portions.

5. The cloth material according to claim 1, wherein a plurality of rows in which the plurality of the welded portions are arranged alternately with non-welded portions lined up in the line are formed.

6. The cloth material according to claim 5, wherein the plurality of rows are formed parallel.

7. The cloth material according to claim 6, wherein the welded portions that are adjacent in a given row, from among the plurality of rows, are arranged such that, if another row were parallel-shifted so as to overlap with the given row, at least a portion of the welded portions in the given row would overlap with the welded portions in the other row, and the alternately arranged welded portions would be connected by the welded portions that are adjacent in the given row overlapping with the plurality of welded portions that have been parallel-shifted.

8. The cloth material according to claim 1, wherein the welded portion are lined up in a direction generally orthogonal to an extending direction of the plurality of the conductive wires.

* * * * *